US005228168A

United States Patent [19]

Hollrock et al.

[11] Patent Number: 5,228,168

[45] Date of Patent: Jul. 20, 1993

[54] GOLF BALL HANDLING SYSTEM

[75] Inventors: Richard H. Hollrock, Simsbury, Conn.; J. Richard Hollrock, South Deerfield, Mass.

[73] Assignee: Hollrock Engineering, Inc., Simsbury, Conn.

[21] Appl. No.: 877,265

[22] Filed: Apr. 28, 1992

Related U.S. Application Data

[63] Continuation-in-part of Ser. No. 717,365, Jun. 19, 1991, abandoned.

[51] Int. Cl.[5] ..... A63B 47/04

[52] U.S. Cl. ..... 15/302; 15/308; 221/266; 406/144

[58] Field of Search ..... 15/21.2, 302, 308; 221/266; 406/144

[56] References Cited

U.S. PATENT DOCUMENTS

| | | | |
|---|---|---|---|
| 1,398,351 | 11/1921 | Williams | 221/266 X |
| 2,853,172 | 9/1958 | Angell | 221/266 X |
| 3,125,775 | 3/1964 | Clifton | 15/21.2 X |
| 3,724,648 | 4/1973 | Schaller | 221/241 X |
| 3,820,183 | 6/1974 | Gustafson et al. | 15/21.2 |
| 4,162,811 | 7/1979 | Hobbs | 406/144 X |
| 4,588,108 | 5/1986 | Knez et al. | 221/266 X |
| 4,712,712 | 12/1987 | Garden | 221/266 X |
| 4,805,251 | 2/1989 | Hollrock | 15/21.2 |
| 5,077,854 | 1/1992 | Moons | 15/21.2 |
| 5,092,526 | 3/1992 | Takata | 406/144 X |
| 5,139,577 | 8/1992 | Brock | 15/21.2 X |

*Primary Examiner*—Chris K. Moore

*Attorney, Agent, or Firm*—McCormick, Paulding & Huber

[57] ABSTRACT

A golf ball washer feeds wet balls into an air moving transport mechanism that drys the balls as they are carried to one of a number of dispensers. The wet balls move by gravity down an inclined infeed chute to a load station where each ball is supported on a flow disrupting ramp, and the transport conduit includes a necked down area at the load station which cooperates with the ramp to disrupt the air flow thereby avoiding the tendency of a spherical golf ball to remain suspended in the column of air rather than being moved downstream through the conduit. Each dispenser has an intermittently driven drum with radially outwardly open pockets to provide predetermined numbers of balls to a basket at the discharge station of the dispenser.

10 Claims, 7 Drawing Sheets

GOLF BALL HANDLING SYSTEM

This is a continuation-in-part of co-pending application Ser. No. 717,365 filed on Jun. 19, 1991 now abandoned.

This invention relates generally to golf ball handling systems, and deals more particularly with a system for transporting golf balls from a golf ball washer to one or more golf ball dispensers of the type which are adapted to supply golf balls to golfers at a practice range or the like.

CROSS REFERENCE TO RELATED APPLICATION

This application is a continuation-in-part of an earlier application Ser. No. 717,365 by the same applicants and since abandoned in favor of the current application.

SUMMARY OF THE INVENTION

In a conventional golf ball washer of the type described in U.S. Pat. No. 4,805,251 for example golf balls are retrieved from a driving range and deposited in a hopper. The balls move downwardly from the hopper into a tank were they follow a path through the tank and are washed by a rotating brush as the balls move along a path defined by the tank from an inlet end to an outlet end of the washer.

In accordance with the present invention these washed golf balls are transported and are dried by a golf ball transport mechanism into which the balls are gravity fed from the ball washer. The balls are conveyed through one or more conduits by air pressure and air movement from adjacent the outlet of the golf ball washer to the inlet or hopper of a golf ball dispenser. The golf ball transport mechanism includes an air moving means for providing a flow of air through the conduit or conduits to not only transport the golf balls from adjacent the outlet of the golf ball washer to one or more golf ball dispensers, but to dry the balls as they are so transported.

Each golf ball dispenser has an opening at the top and hopper means for storing or accumulating golf balls. A chute is provided for directing the balls from this storage area preferably by gravity toward a rotating drum where the balls are formed into predetermined groups or charges. The rotatable drum has a plurality of radially outwardly open pockets, and means is provided for periodically rotating the drum from a first angular position such that the balls move by gravity from the chute into one pocket to a second angular position such that the balls move by gravity out of a second pocket. Guide means is provided in association with the balls exiting the pocket for directing these balls into a basket or the like provided on a shelf at the discharge station in the ball dispenser.

BRIEF DESCRIPTION OF THE DRAWINGS

FIG. 1A is a sectional view on line 1A—1A.

FIG. 1B is a sectional view on line 1B—1B.

DETAILED DESCRIPTION OF THE PREFERRED EMBODIMENT

Figure 1:
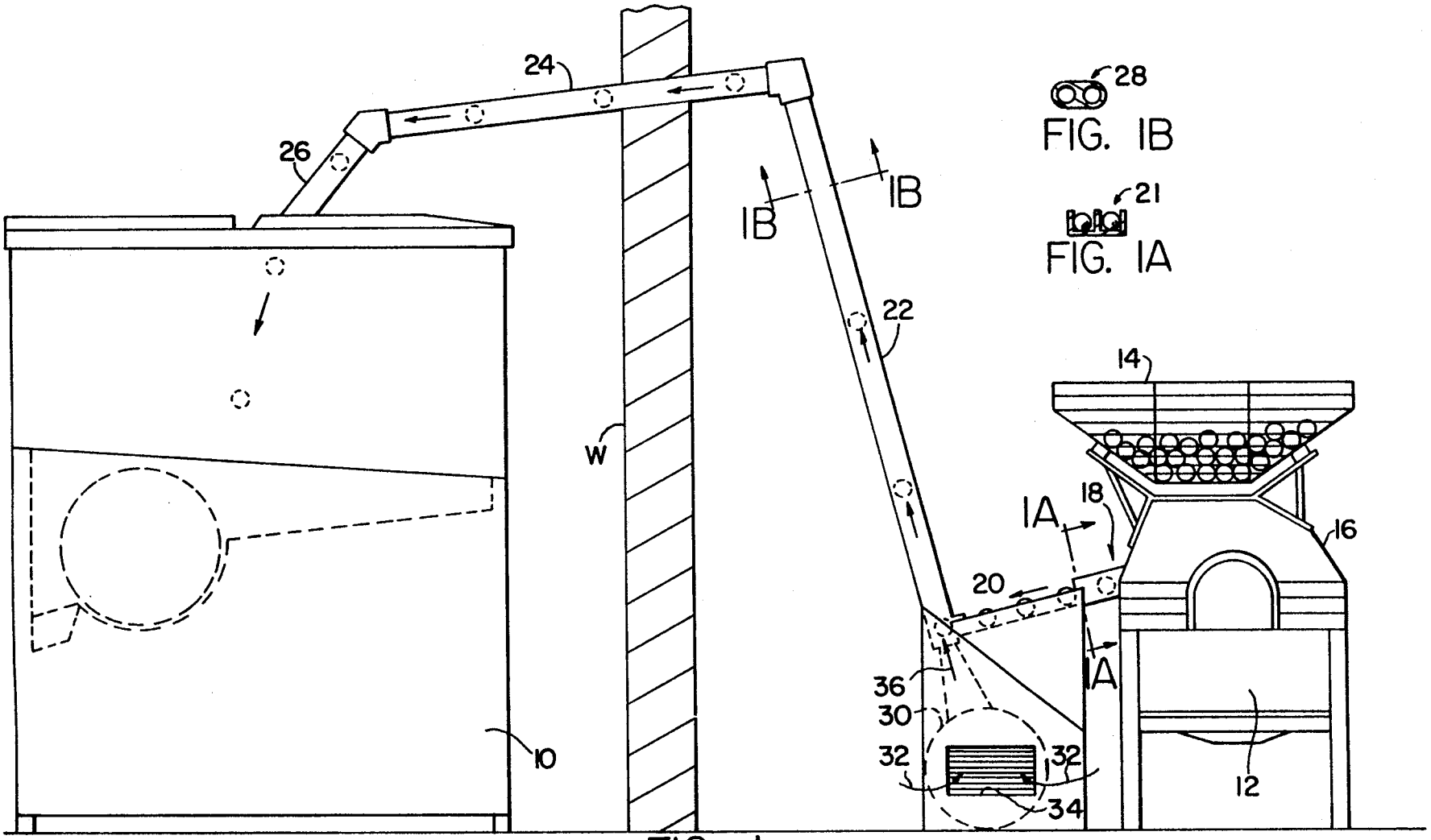
FIG. 1 is an elevational view illustrating in a somewhat schematic fashion the relationship between the golf ball washer, the golf ball transport mechanism, and the golf ball dispense..

As illustrated in FIG. 1 a golf ball dispenser 10 is provided in front of a wall W and several such dispensers might be provided in spaced relationship along this wall in a typical driving range environment.

Out of sight behind the wall W is provided a conventional ball washer 12 which may be similar to that described and shown in U.S. Pat. No. 4,805,251. This ball washer patent disclosure is incorporated by reference herein, but any conventional ball washer might be substituted for that indicated generally at 12 without departing from the scope of the present invention. Typically, such a ball washer includes a hopper 14 provided above a tank 16 and inside the tank a rotating brush drives the golf balls around one or more generally helical paths from an inlet end associated with the hopper 14 to an outlet end indicated generally at 18 in FIG. 1. The balls after being washed are still quite wet from the washing operation and move by gravity down an inclined chute indicated generally at 20.

In accordance with the present invention the balls are transported by a golf ball transport mechanism comprising conduits 22, 24, and 26. These conduits may be double conduits as suggested generally at 28 in FIG. 1B in which case the outlet chute 20 associated with the ball washer 12 may comprise side-by-side tracks as suggested generally at 21 in FIG. 1A. As disclosed in the above mentioned U.S. Pat. No. 4,805,251 two such tracks are provided within the ball washer for feeding twin conduits such as indicated generally at 22, 24 and 26.

The golf ball transport mechanism further includes air moving means preferably in the form of a blower 30 which receives ambient air as suggested by the arrows 32, 32. The air is drawn through the inlet 34 by the blower and exhausted upwardly as suggested generally by the arrow 36 so as to provide a continuous stream of air through the conduits 22, 24 and 26. The blower operates when the ball washer operates.

As so constructed and arranged the golf ball transport mechanism not only serves to deliver the washed golf balls from the washer 12 to the dispenser 10, but also serves to dry the balls while they are moving from the washer to the dispenser as a result of the air flow generated by the blower system 30.

Figure 2:
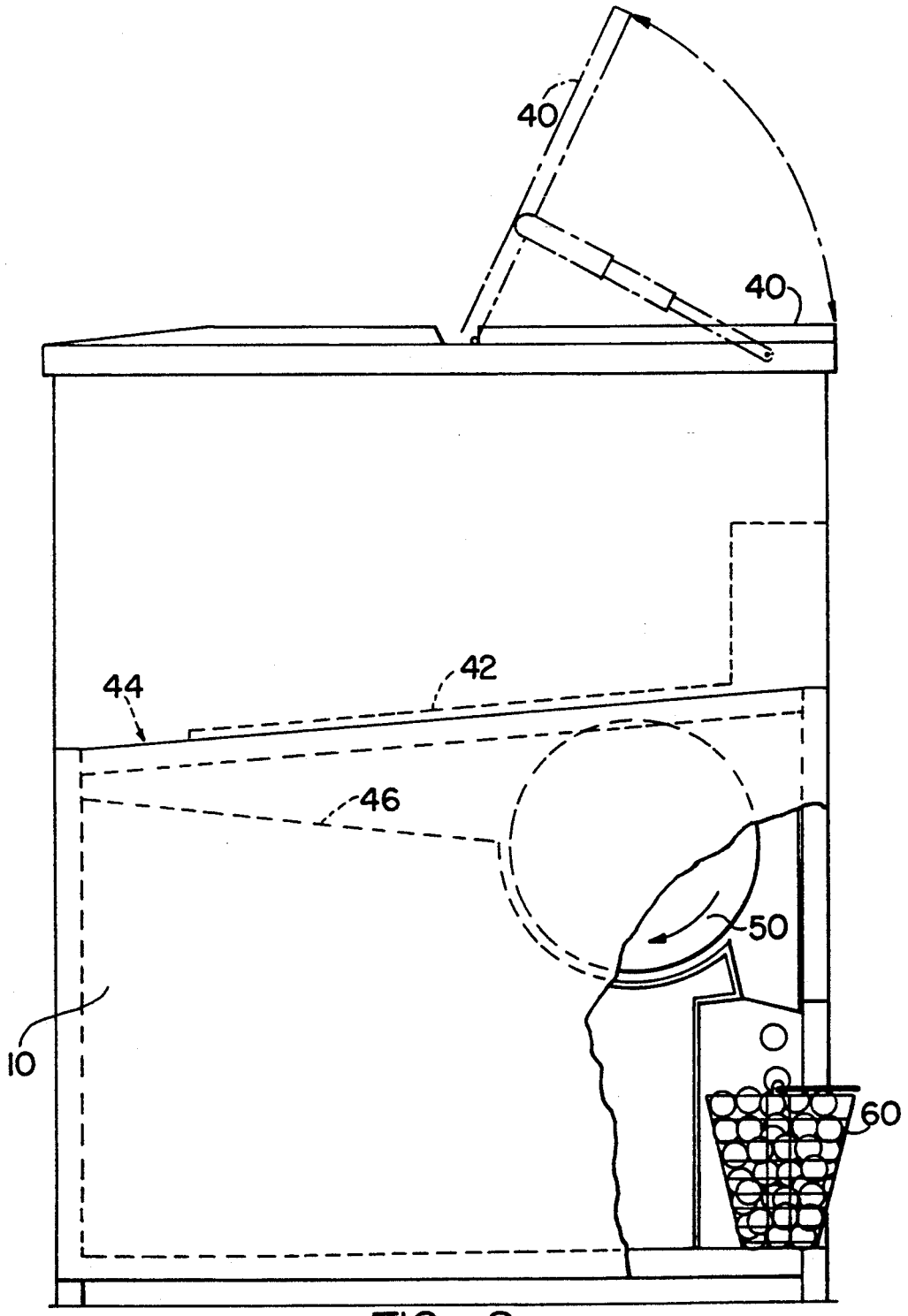
FIG. 2 is a left-hand side elevational view of the golf ball dispenser.

Turning next to a detailed description of the golf ball dispenser 10, FIG. 2 illustrates the dispenser in its preferred form as including a top cover or lid 40 which may be moved from the solid to the phantom line position shown for allowing manual filling of the dispenser during manual operation, that is when golf balls are not conveyed directly to the dispenser via the conduits system 22, 24 and 26 described previously. Still with reference to FIG. 2, a removable inclined shelf 42 is provided for defining a storage or accumulation area for the golf balls delivered to the dispenser.

Figure 4:
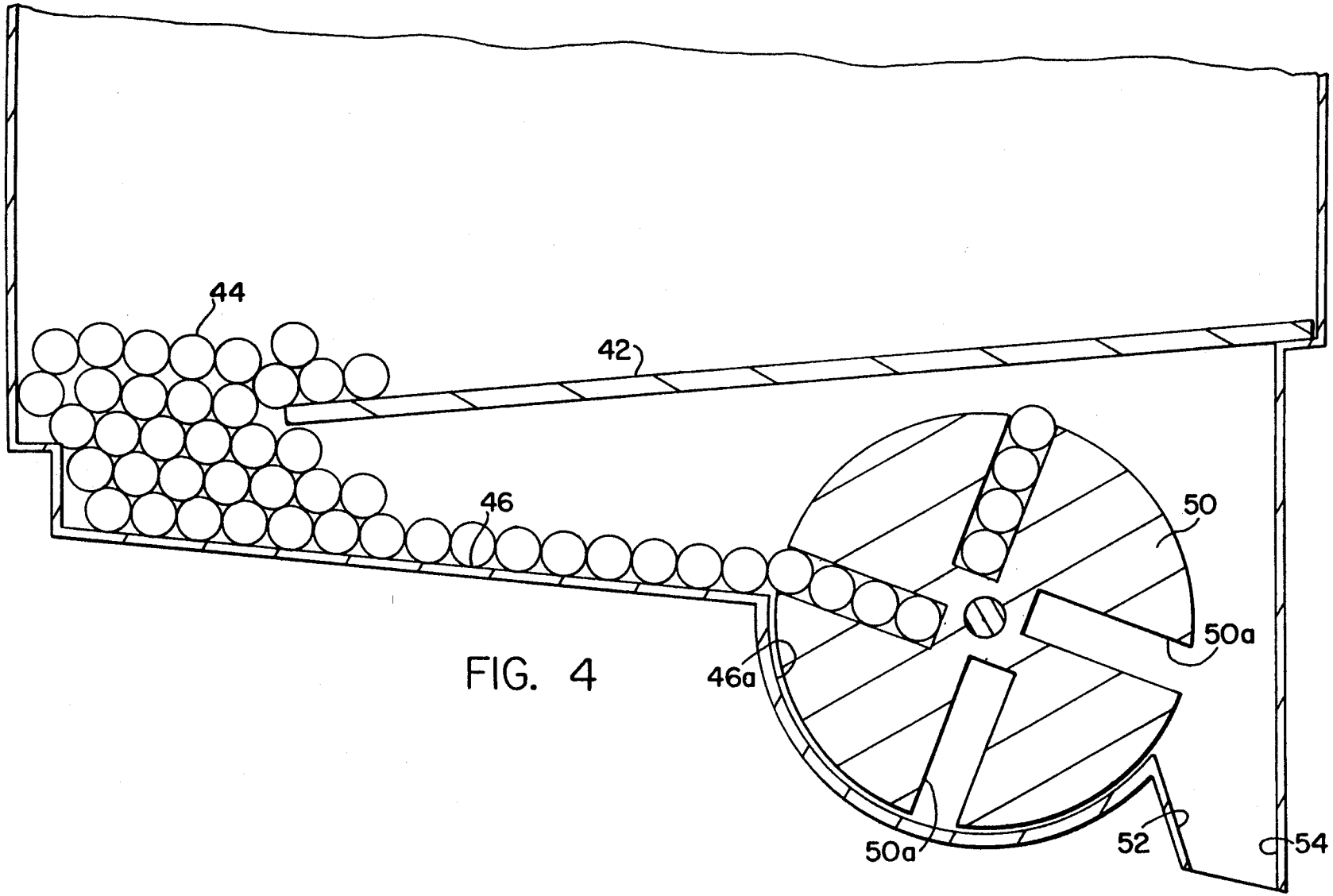
FIG. 4 is an enlarged view of a portion of the golf ball dispenser illustrating the rotating drum and the chute for feeding golf balls to the drum.

The balls move downwardly on shelf 42 from right to left in FIG. 2, where they will be received in an opening indicated generally at 44, which opening leads to an oppositely inclined surface 46 where the balls will assume a single layer on this inclined surface 46 as best shown in FIG. 4.

Figure 3:
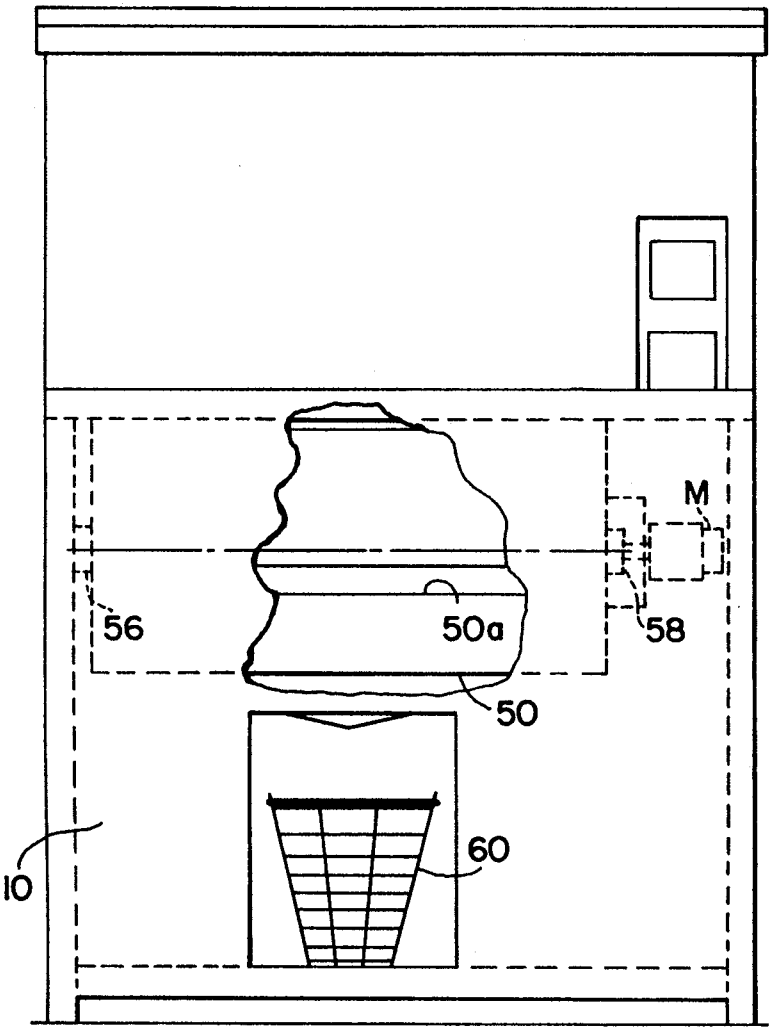
FIG. 3 is a front elevational view thereof with portions broken away to better illustrate the rotating drum provided inside the dispenser.

With particular reference to FIG. 4, a rotatable drum 50 is provided with four radially outwardly open pockets 50*a*, 50*a*. Means is provided for rotating the drum 50 incrementally through 90° of angular rotation. That is, the drum 50 moves from the first position illustrated in FIG. 4 through that illustrated in FIG. 5 to and slightly beyond a discharge position such as that illustrated at FIG. 6. The golf balls that had been accumulated in the pocket in the top FIG. 4 position are dropped by gravity out of that pocket by the time the drum has moved through 90°. Guide means, indicated generally at 52 and 54, direct these balls as they drop downwardly into a receptacle of the type indicated generally at 60 in FIGS. 2 and 3.

Figure 7:
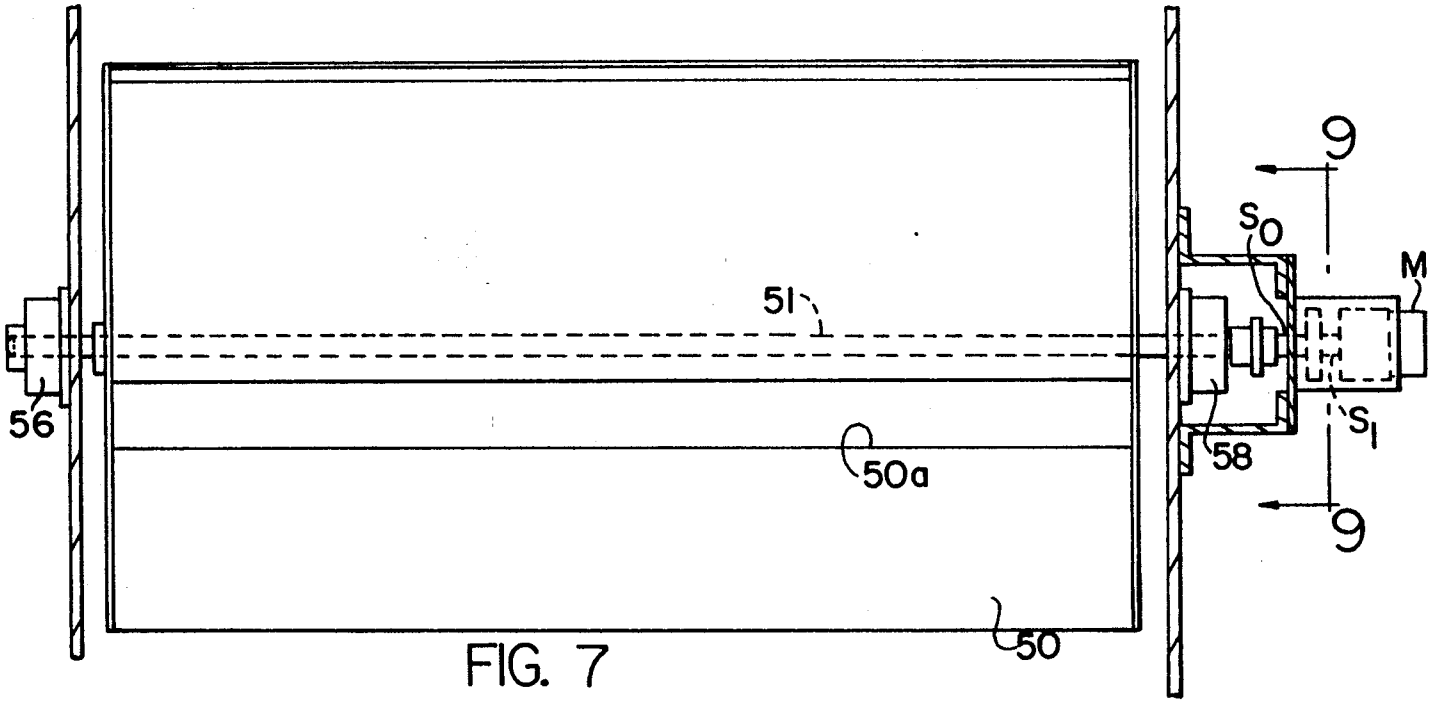
FIG. 7 is an enlarged view of the rotating drum illustrated in FIG. 3.

As shown in FIG. 7 the drum 50 is supported for rotation on a shaft 51 journalled as shown at 56 and 58. An automatic motor-brake M has a motor shaft $S_1$ that is coupled to an output shaft $S_0$ and the drum shaft 51*a* by an eddy current brake.

Figure 9:
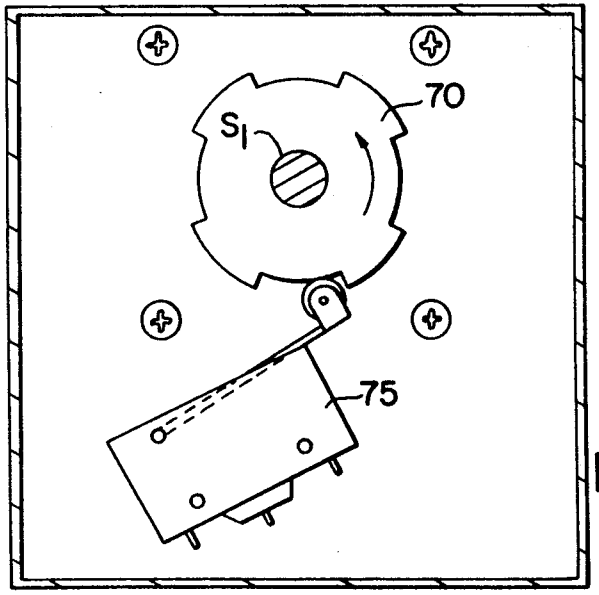
FIG. 9 is a sectional view taken on the line 9—9 of FIG. 7.

A limit switch 75 and cam 70 on the motor shaft $S_1$ control the output shaft from the brake to provide automatic intermittent motion of the drum 50 with brief dwell periods such that each pocket 50*a* is in turn aligned with the inclined surface 46. FIG. 9 shows a four lobe cam for achieving the 90° rotations and four dwell periods required with the four pocket drum shown.

Figure 5:
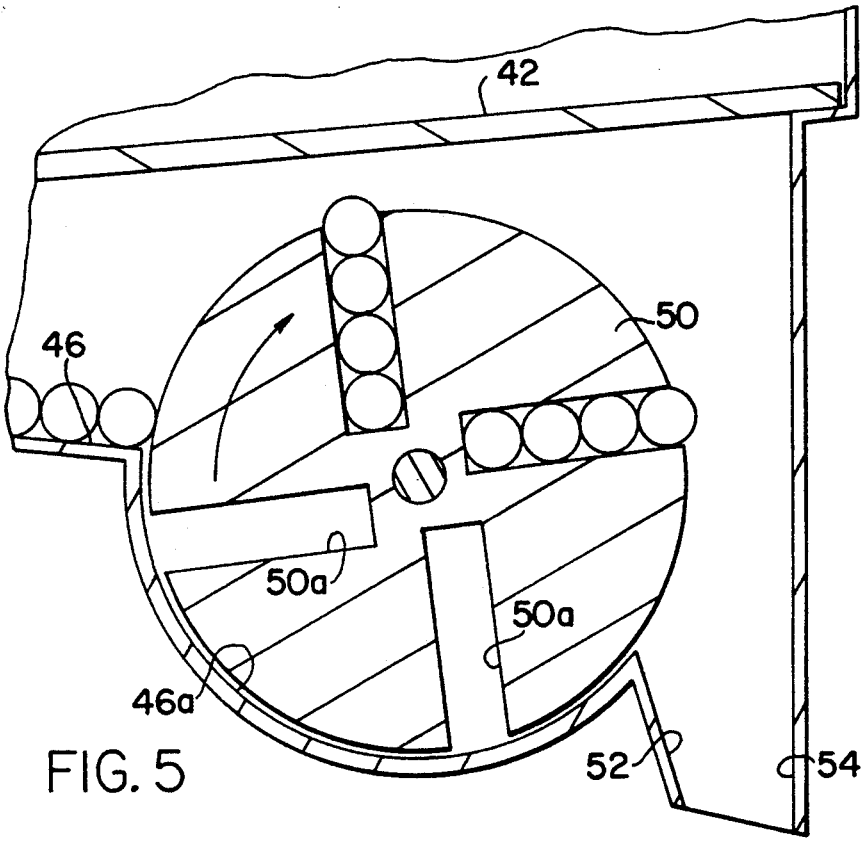
FIG. 5 is a view of the rotating drum illustrated in FIG. 4, but taken at a slightly later instant of time.
Figure 6:
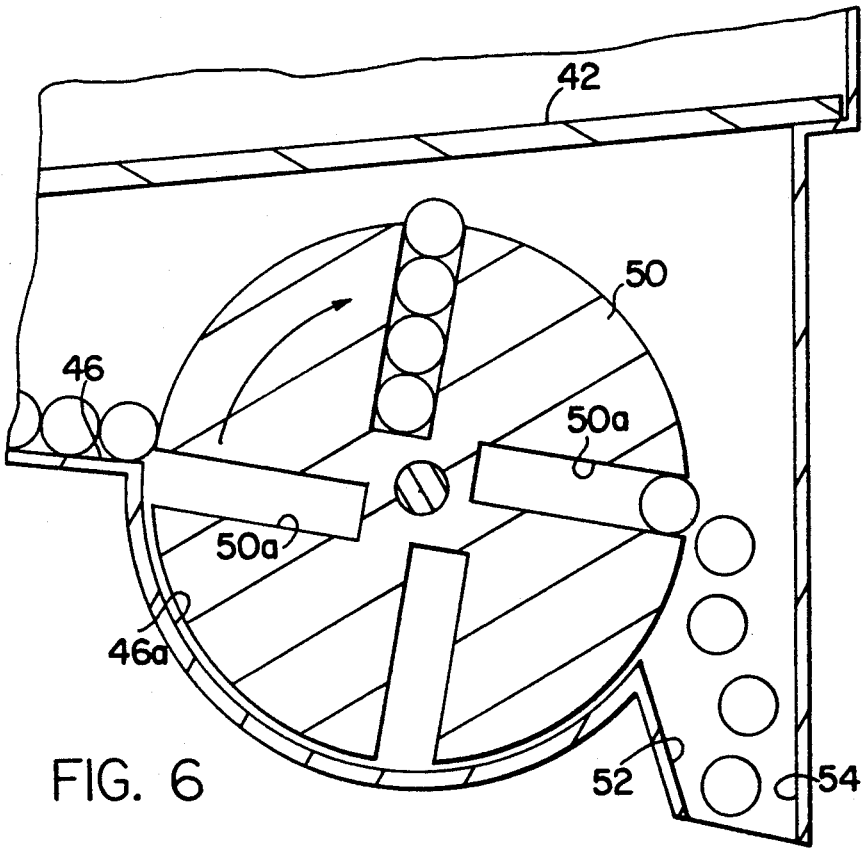
FIG. 6 is a view similar to FIG. 5, but illustrating the balls exiting the drum pocket.

An arcuate wall 46*a* may be provided around the lower periphery of the drum between the shelf 46 and the discharge chute 52–54 as best shown in FIGS. 4–6.

Figure 8:
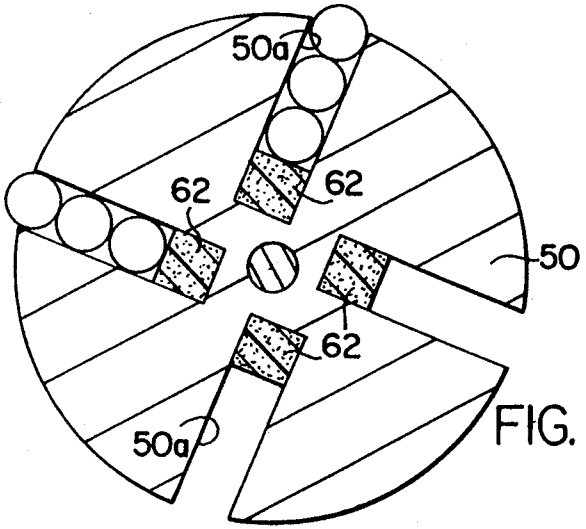
FIG. 8 is a view of the rotor with filler strip means for reducing the volume of the pockets in the rotor.

In the event that the number of golf balls to be handled per pocket is to be reduced for any reason from the capacity suggested in FIGS. 4–7 the pockets 50*a*, 50*a* can be reduced in size by inserting filler strips 62, 62 as shown in FIG. 8.

Figure 10:
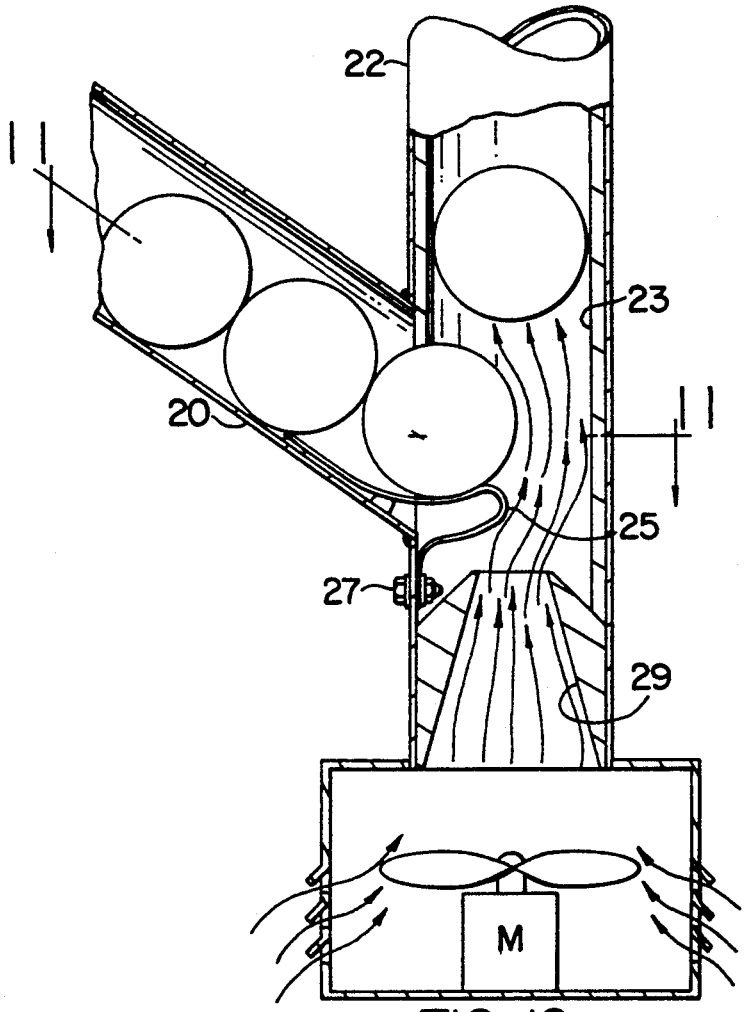
FIG. 10 is a vertical section taken through the intersection between the gravity feed tube from the washer to the load station of the golf transport system illustrating the internal construction thereof in greater detail.
Figure 11:
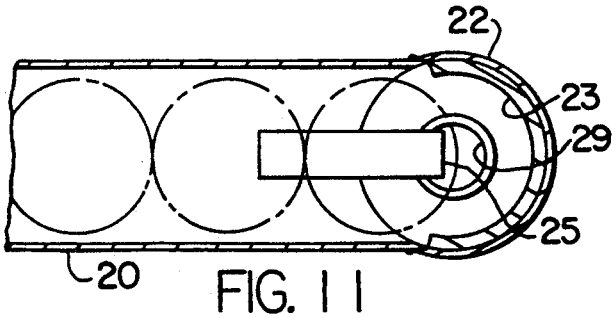
FIG. 11 is a view taken generally on the line 11—11 of FIG. 10.

Turning now to a description of the detailed interface between the golf ball gravity feed tube or chute and the air transport conduit or tube, FIGS. 10 and 11 illustrate golf balls proceeding by gravity down the inclined tube 20 into the above described load station where the balls are moved by air pressure upwardly through the conduit 22 for transport to a discharge station associated with the golf ball dispenser described previously.

The load station includes a golf ball retaining ramp 25 which is secured to the lower end of the tube 22 by a fastener 27 so as to provide support for the ball entering the load station. This ramp may be in the form of a leaf spring having a mid-portion so shaped as to receive and to support the ball at the load station. This spring is also effective to upset the flow of air from the nozzle 29 at the lower end of the tube 22 and thereby avoid the tendency of the spherically shaped ball to float momentarily at the load station in an equilibrium position with the air passing symmetrically around it inside the tube. This ball suspension situation of the ball at the load station must be avoided because the ball will fail to immediately move upwardly in the tube 22. The ramp/-spring 25 serves both purposes described above.

By providing the formed spring-like ramp 25 at the load station the air flow to the load station is disrupted to the extend required for assuring that the ball will move upwardly in the tube 22. In order to further enhance the upward movement of the ball from the load station into the tube 22, a liner 23 is provided inside the tube 22 which liner has an inner diameter corresponding closely to the diameter of the golf ball itself. The sleeve or liner 23 also tends to avoid the ball suspension situation described in the preceding paragraph.

The combination of providing a sleeve diameter corresponding to that of the golf ball when taken in combination with the air disrupting ramp 25 provided at the load station has been found to prevent the above mentioned tendency for the golf ball to remain suspended in position while the airflow equalizes itself around the spherically shaped ball in the tube 22.

In conclusion then the improvement described herein provides for support of the golf ball at the load station, and for disrupting the inherently symmetrical flow normally provided in a cylindrical conduit or tube such as will normally lead to the suspension of a spherical object in such a symmetrical air pattern, and thereby prevent movement of the ball upwardly in the tube, and thwarting the object of the present invention namely to transport each golf bal in turn from the load station to a discharge station.

I claim:

1. A golf ball handling system comprising a golf ball washer having a hopper for receiving balls to be washed, a tank defining a generally helical path for the balls being washed, a brush for causing movement of the balls through the tank from an inlet adjacent said hopper to an outlet where the wet balls exit the washer, golf ball transport means including a conduit for carrying the balls away from the washer outlet, said golf ball transport means also including air moving means coupled to said conduit for drying wet balls as they move along said conduit, and a golf ball dispenser for receiving the balls from said conduit and providing selective release of predetermined numbers of balls at a golf ball dispensing station in said dispenser.

2. The combination according to claim 1 wherein said air moving means comprises a blower having a discharge side coupled to said conduit for moving the balls along said conduit.

3. The combination according to claim 2 wherein a golf ball dispenser comprises an infeed station, and means for storing or accumulating golf balls adjacent said infeed station, a chute for directing the balls from said ball storing and accumulating means toward a station where the balls are formed into predetermined groups, a rotatable drum having a plurality of radially outwardly open pockets at said charge forming station, and means for rotating the drum from a first angular position such that the balls move by gravity from the chute into said discharge station of said ball dispenser.

4. The combination according to claim 3 wherein said means for rotating said drum provides for intermittent dwell periods for said pocket at said first and second angular positions.

5. The combination according to claim 4 wherein said drum has pockets of axially elongated configuration with a width only slightly greater than that of the golf balls to be contained therein, each of said pockets having a radially extending wall and a parallel wall both of which extend parallel to the axis of rotation of the drum.

6. The combination according to claim 5 wherein filler strips are provided for selective placement into said pockets to reduce the volume of said pockets and hence to reduce the number of golf balls within a particular charge.

7. The combination according to claim 6 wherein said conduit comprises a first segment having a lower end and an upper end, means for feeding the balls by gravity from the outlet of the ball washer into the lower end of said first conduit segment, and said air moving means comprising a blower provided with an outlet adjacent said first conduit end.

8. The combination according to claim 7 wherein said gravity fed golf balls are received one at a time adjacent said first conduit segment in order to provide the improved drying action for each ball as each ball is transported from the first to the second end of said first conduit segment.

9. The combination according to claim 8 wherein said ball washer defines two parallel helical paths for handling the streams of golf balls in side-by-side relationship, and wherein said gravity outlet chute associated with said washer outlet includes two side-by-side tracks for the wet balls, and at least two parallel first conduits having inlets for receiving balls from said two side-by-side tracks, said blower providing air under pressure at said lower end of each of said parallel conduit segments.

10. A golf ball handling system comprising a golf ball washer having a tank containing a liquid and defining a path for balls being washed as they move from an inlet of the washer to an outlet where the wet balls exit the washer, golf ball transport means including a conduit for carrying the balls away from said washer outlet, said golf ball transport means including air moving means coupled to said conduit for drying wet balls as they move along said conduit, and a golf ball dispenser for receiving the balls from said conduit and providing selective release of predetermined numbers of balls at a golf ball dispensing station.

* * * * *